United States Patent [19]

Ando et al.

[11] Patent Number: 4,854,487

[45] Date of Patent: Aug. 8, 1989

[54] MOLTEN STEEL POURING NOZZLE

[75] Inventors: Mitsuru Ando; Toshikazu Takasu, both of Gifu, Japan

[73] Assignee: Akechi Ceramics Co., Ltd., Gifu, Japan

[21] Appl. No.: 280,379

[22] Filed: Dec. 5, 1988

[30] Foreign Application Priority Data

Dec. 21, 1987 [JP] Japan ..... 62-193579

[51] Int. Cl.[4] ..... B22D 41/08

[52] U.S. Cl. ..... 222/606; 266/236

[58] Field of Search ..... 222/591, 590, 603, 606, 222/607; 266/236, 287

[56] References Cited

U.S. PATENT DOCUMENTS 4,429,816 2/1984 Thrower ..... 222/606

4,756,452 7/1988 Tsukamoto et al. ..... 266/236

FOREIGN PATENT DOCUMENTS 62-279072 3/1987 Japan .

2179573 3/1987 United Kingdom ..... 222/603

*Primary Examiner*—S. Kastler

*Attorney, Agent, or Firm*—Frishauf, Holtz, Goodman & Woodward

[57] ABSTRACT

A molten steel pouring nozzle comprising an upper nozzle made of a refractory, an upper end portion of which is to be inserted into a bottom wall of a molten steel receiving vessel; a lower nozzle made of a refractory, having, on an upper end portion thereof, a recess for receiving a lower end portion of the upper nozzle; and an open air shutoff means for preventing an open air from penetrating through an interface between the lower end portion of the upper nozzle and the recess of the lower nozzle. The open air shutoff means comprises a steel shell covering the upper end portion of the lower nozzle and having on a side surface thereof an inert gas feed port; an annular equalizing chamber, provided between the upper end portion of the lower nozzle and the side surface of the steel shell, communicating with the inert gas feed port of the steel shell; and a plurality of grooves formed between the upper end surface of the lower nozzle and the upper surface of the steel shell, one end of each of the grooves communicating with the annular equalizing chamber, and the other end thereof communicating with the recess of the lower nozzle.

1 Claim, 3 Drawing Sheets

MOLTEN STEEL POURING NOZZLE

REFERENCE TO PATENTS, APPLICATIONS AND PUBLICATIONS PERTINENT TO THE INVENTION

As far as we know, there is available the following prior art document pertinent to the present invention: Japanese Patent Provisional Publication No. 62-279,072 dated Dec. 3, 1987.

The contents of the prior art disclosed in the above-mentioned prior art document will be discussed later under the heading of the "BACKGROUND OF THE INVENTION".

FIELD OF THE INVENTION

The present invention relates to a molten steel pouring nozzle, which is to be fitted to a bottom wall of a molten steel receiving vessel such as a ladle or a tundish.

BACKGROUND OF THE INVENTION

The usual practice for continuous casting of molten steel comprises pouring molten steel received in a tundish from a ladle through a monolithic molten steel pouring nozzle fitted to a bottom wall of the tundish into a vertical mold arranged below the molten steel pouring nozzle to form a cast strand, and continuously withdrawing the thus formed cast strand in the form of a long strand.

Since a lower end portion of the above-mentioned monolithic molten steel pouring nozzle is immersed into molten steel in the vertical mold, the lower end portion suffers from particularly serious erosion. As a result, the monolithic molten steel pouring nozzle poses an economic problem of a relatively short service life.

For the purpose of solving the above-mentioned economic problem, therefore, a molten steel pouring nozzle comprising an upper nozzle and a lower nozzle has recently been employed. According to the molten steel pouring nozzle of this type, even if a lower end portion of the lower nozzle is immersed into molten steel in a vertical mold and seriously eroded, it suffices to replace only the lower nozzle, so that the above-mentioned problem is solved.

In the above-mentioned molten steel pouring nozzle, for the purpose of preventing an open air from penetrating through an interface between the upper nozzle and the lower nozzle into a vertical path for molten steel formed by the bores of both of the upper and lower nozzles and thus preventing oxidation of molten steel flowing through the vertical path, it is the usual practice to improve sealing property of the above-mentioned interface by arranging sealing members comprising a ceramic fiber or an alumina-based castable refractory on the interface between the upper nozzle and the lower nozzle.

By such a means, however, it is impossible to obtain a sufficient sealing property of the interface between the upper nozzle and the lower nozzle.

In order to solve this problem, a molten steel pouring nozzle capable of giving a sufficient sealing property of the interface between the upper nozzle and the lower nozzle is disclosed in Japanese Patent Provisional Publication No. 62-279,072 dated Dec. 3, 1987 (hereinafter referred to as the "prior art"). The molten steel pouring nozzle A of the prior art is described below with reference to FIG. 1.

FIG. 1 is a schematic vertical partial sectional view illustrating the molten steel pouring nozzle A of the prior art, which is to be fitted to a bottom wall of a molten steel receiving vessel such as a ladle or a tundish. As shown in FIG. 1, the molten steel pouring nozzle A of the prior art comprises an upper nozzle 1 made of a refractory, a lower nozzle 4 made of a refractory, and an open air shutoff means 11.

The upper nozzle 1 has along the center axis thereof an upper bore 2, and an upper end portion of the upper nozzle 1 is to be vertically inserted into an opening provided in a bottom wall of a tundish (not shown) as a molten steel receiving vessel. A lower end portion 3 of the upper nozzle 1 is tapered.

The lower nozzle 4 has along the center axis thereof a lower bore 5 aligning with the upper bore 2, and has, on an upper end portion 6 thereof, a recess 7 for receiving the lower end portion 3 of the upper nozzle 1. The recess 7 is formed coaxially with the lower bore 5 and communicates therewith. An annular notch 10 for receiving a sealing member 15 described later as one of the components of the open air shutoff means 11 is formed throughout the entire circumference of the upper end portion 6 of the lower nozzle 4.

The open air shutoff means 11 comprises a steel shell 12 covering the upper end portion 6 of the lower nozzle 4, a sealing member 15 made of a porous refractory arranged between the upper end portion 6 of the lower nozzle 4 and the steel shell 12, and an annular equalizing chamber 18 defined by the steel shell 12 and the sealing member 15.

The steel shell 12 comprises a side surface **12*b* formed into a cylindrical shape so as to cover the circumference of the upper end portion 6 of the lower nozzle 4, and an upper surface 12*a* welded to the upper end of the side surface 12*b*. The upper surface 12*a* of the steel shell 12 has, at the center thereof, an opening 13 for receiving the lower end portion 3 of the upper nozzle 1, and the opening 13 has a size slightly larger than that of the recess 7 of the lower nozzle 4. The side surface 12*b* of the steel shell 12 has, at the upper end portion thereof, an inert gas feed port 14. The side surface 12*b* of the steel shell 12 is stuck to the upper end portion 6 of the lower nozzle 4 by means of an adhesive 19 such as mortar, and the upper surface 12*a* of the steel shell 12 is welded to the upper end of the side surface 12*b* of the steel shell 12 after the sealing member 15 made of a porous refractory has been fitted to the upper end portion 6 of the lower nozzle 4**.

The sealing member 15 made of a porous refractory is formed into an annular shape between the upper end surface of the lower nozzle 4 and the upper surface **12*a* of the steel shell 12 so as to cover the lower end portion 3 of the upper nozzle 1. More specifically, the sealing member 15 is arranged between the upper end surface of the lower nozzle 4 and the upper surface 12*a* of the steel shell 12, and has a bore 15' for receiving the lower end portion 3 of the upper nozzle 1 at the center of the sealing member 15. The bore 15' of the sealing member 15 therefore receives the lower end portion 3 of the upper nozzle 1 in cooperation with the recess 7 of the lower nozzle 4. The sealing member 15 has, throughout the entire circumference thereof, an annular notch 16 for forming the annular equalizing chamber 18 in cooperation with the side surface 12*b* of the steel shell 12. Furthermore, the sealing member 15 has, on the lower end portion thereof, an annular projection 17 engaging with the annular notch 10 of the lower nozzle 4. The sealing member 15 is secured to the upper end surface of the lower nozzle 4 by means of an adhesive such as mortar in the state that the annular projection 17 of the sealing member 15 engages with the annular notch 10 of the lower nozzle 4. In this state, the annular equalizing chamber 18 communicates with the inert gas feed port 14 of the steel shell 12, and the inert gas feed port 14** is connected through a pipe (not shown) to an inert gas source (not shown).

According to the molten steel pouring nozzle A of the prior art having the construction as described above, an inert gas supplied from the inert gas source (not shown) through the inert gas feed port 14 into the annular equalizing chamber 18 flows through numerous pores in the sealing member 15 made of a porous refractory, is ejected toward the lower end portion 3 of the upper nozzle 1, and discharged to the open air through the gap between the edge of the opening 13 in the upper surface 12*a* of the steel shell 12 and the lower end portion 3 of the upper nozzle 1. As a result, the circumference of the lower end portion 3 of the upper nozzle 1 is filled with the inert gas, thus preventing the open air from penetrating through an interface 9 between the lower end portion 3 of the upper nozzle 1 and the recess 7 of the lower nozzle 4 into a vertical path 8 for molten steel formed by the upper bore 2 of the upper nozzle 1 and the lower bore 5 of the lower nozzle 4.

However, the above-mentioned molten steel pouring nozzle A of the prior art has the following problems. The sealing member 15, being made of the porous refractory, is inferior in spalling resistance to the upper nozzle 1 and the lower nozzle 4. Therefore, cracks may occur in the sealing member 15 due to sudden temperature changes during operation. If cracks occur in the sealing member 15, it becomes impossible to uniformly eject inert gas toward the lower end portion 3 of the upper nozzle 1, thus allowing an open air to penetrate through the interface 9 between the lower end portion 3 of the upper nozzle 1 and the recess 7 of the lower nozzle 4 into the vertical path 8 for molten steel, and hence leading to a lower quality of the cast steel strand. In addition, because of the large number of parts of the molten steel pouring nozzle A of the prior art, fabrication of the individual parts and the assembly operations thereof are complicated and tend to result in a high manufacturing cost.

The above-mentioned problems are posed also when pouring molten steel received in a ladle into a tundish through the molten steel pouring nozzle A of the prior art fitted to a bottom wall of the ladle.

Under such circumstances, there is a strong demand for development of a molten steel pouring nozzle which ensures a sufficient sealing property of an interface between the upper nozzle and the lower nozzle, thus preventing deterioration of the quality of a cast steel strand caused by the penetration of an open air through the above-mentioned interface, and is manufacturable at a low cost, but such a molten steel pouring nozzle has not as yet been proposed.

SUMMARY OF THE INVENTION

An object of the present invention is therefore to provide a molten steel pouring nozzle which ensures a sufficient sealing property of an interface between the upper nozzle and the lower nozzle, thus preventing deterioration of the quality of a cast steel strand caused by the penetration of an open air through the above-mentioned interface, and is manufacturable at a low cost.

In accordance with one of the features of the present invention, there is provided a molten steel pouring nozzle, comprising:

an upper nozzle (20) made of a refractory, having along the center axis thereof an upper bore (21), an upper end portion of said upper nozzle (20) inserted into an opening provided in a bottom wall of a molten steel receiving vessel;

a lower nozzle (23) made of a refractory, having along the center axis thereof a lower bore (24) aligning with said upper bore (21), and having, on an upper end portion (25) thereof, a recess (26, 26') for receiving a lower end portion (22) of said upper nozzle (20), said lower bore (24) of said lower nozzle (23) forming a vertical path (27) for molten steel in cooperation with said upper bore (21) of said upper nozzle (20); and an open air shutoff means (31) for preventing an open air from penetrating through an interface (28, 28') between said lower end portion (22) of said upper nozzle (20) and said recess (26, 26') of said lower nozzle (23) into said vertical path (27) for molten steel, said open air shutoff means comprising:

a steel shell (32) covering said upper end portion (25) of said lower nozzle (23), said steel shell having, at the center of an upper surface (32*a*) thereof, an opening (33) having a size slightly larger than that of said recess (26, 26') of said lower nozzle (23), for receiving said lower end portion (22) of said upper nozzle (20), and said steel shell (32) having, on a side surface (32*b*) thereof, an inert gas feed port (34);

an annular equalizing chamber (35), provided between said upper end portion (25) of said lower nozzle (23) and said side surface (32*b*) of said steel shell (32), over the entire circumference of said upper end portion (25) of said lower nozzle (23), said annular equalizing chamber communicating with said inert gas feed nozzle (34) of said steel shell (32); and a plurality of grooves (36, 36*a*, 36*b*, 36*c*, 36*d*) formed at prescribed intervals in the circumferential direction of said lower nozzle (23) between an upper end surface (30) of said lower nozzle (23) and said upper surface (32*a*) of said steel shell (32), said plurality of grooves being directed toward said lower end portion (22) of said upper nozzle (20), one end of each of said plurality of grooves communicating with said annular equalizing chamber (35), and the other end thereof communicating with said recess (26, 26') of said lower nozzle (23).

DETAILED DESCRIPTION OF PREFERRED EMBODIMENTS

From the above-mentioned point of view, extensive studies were carried out to develop a molten steel pouring nozzle which ensures a sufficient sealing property of an interface between the upper nozzle and the lower nozzle, thus preventing deterioration of the quality of a cast steel strand caused by the penetration of an open air through the above-mentioned interface, and is manufacturable at a low cost.

As a result, the following finding was obtained. It is possible to eject an inert gas always uniformly toward the lower end portion of the upper nozzle, reduce the number of parts for the molten steel pouring nozzle, and thus to reduce the manufacturing cost, by providing an annular equalizing chamber, between the upper end portion of the lower nozzle and the side surface of the steel shell, over the entire circumference of the upper end portion of the lower nozzle, and forming a plurality of grooves for directing an inert gas supplied in the annular equalizing chamber toward the lower end portion of the upper nozzle, at prescribed intervals in the circumferential direction of the lower nozzle, between the upper end surface of the lower nozzle and the upper surface of the steel shell, in place of using a sealing member made of a porous refractory as in the molten steel pouring nozzle of the prior art.

The present invention was made on the basis of the above-mentioned finding. Now, a first embodiment of the molten steel pouring nozzle of the present invention is described with reference to the drawings.

Figure 2:
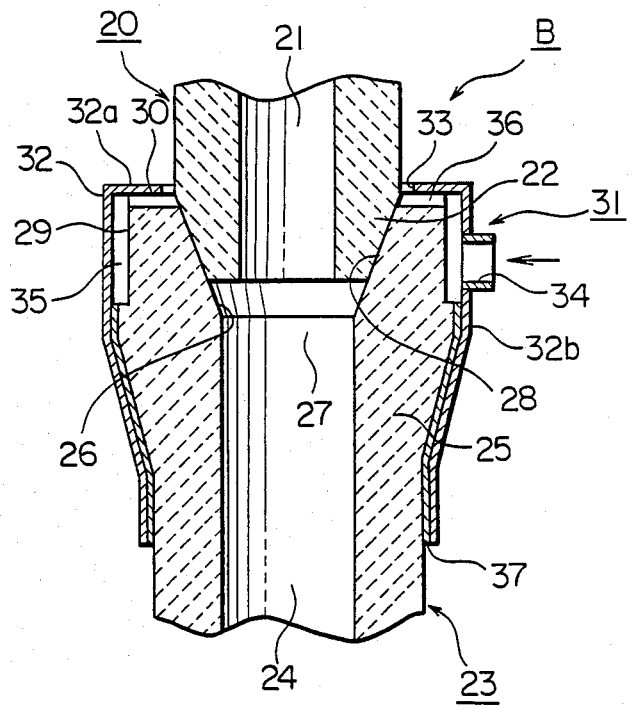
FIG. 2 is a schematic vertical partial sectional view illustrating a first embodiment of the molten steel pouring nozzle of the present invention, which is to be fitted to a bottom wall of a molten steel receiving vessel such as a ladle or a tundish.
Figure 3:
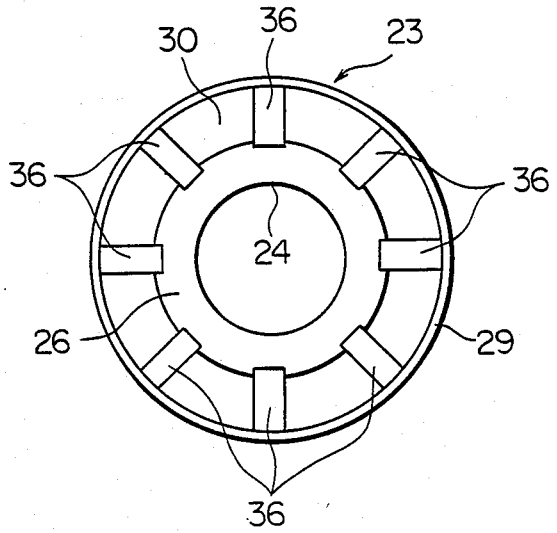
FIG. 3 is a plan view illustrating the lower nozzle as one of the components of the molten steel pouring nozzle of the present invention shown in FIG. 2.
Figure 4:
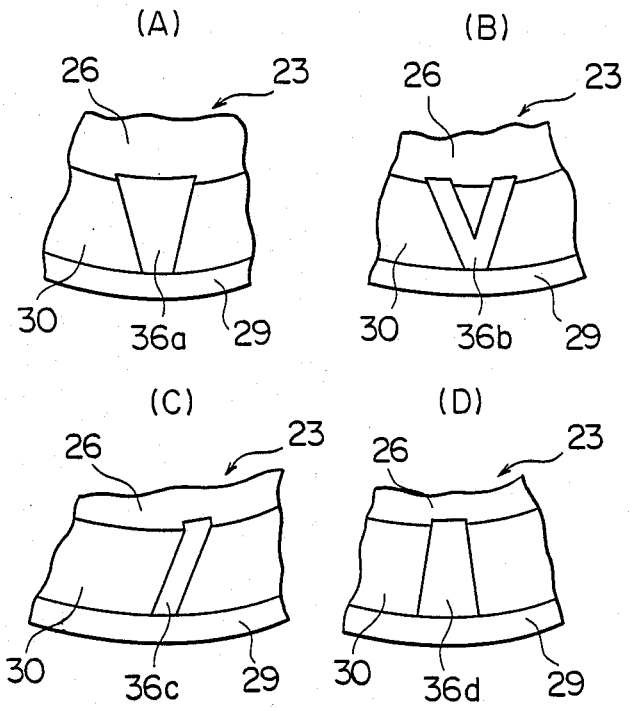
FIGS. 4(A) to 4(D) are plan views illustrating variations of a plurality of grooves provided on the lower nozzle shown in FIG. 3, as one of the components of the molten steel pouring nozzle of the present invention.

FIG. 2 is a schematic vertical partial sectional view illustrating a first embodiment of the molten steel pouring nozzle of the present invention, which is to be fitted to a bottom wall of a molten steel receiving vessel such as a ladle or a tundish; and FIG. 3 is a plan view illustrating the lower nozzle as one of the components of the molten steel pouring nozzle shown in FIG. 2.

Figure 1:
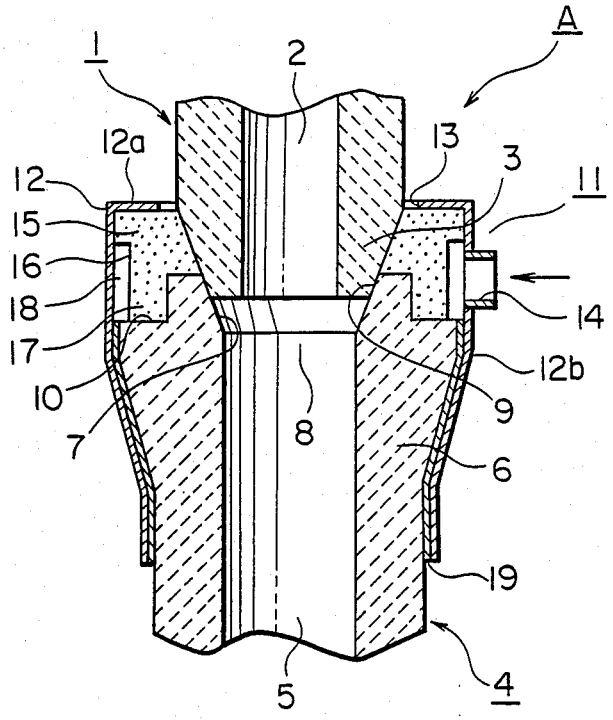
FIG. 1 is a schematic vertical partial sectional view illustrating the molten steel pouring nozzle of the prior art, which is to be fitted to a bottom wall of a molten steel receiving vessel such as a ladle or a tundish.

As shown in FIGS. 1 and 2, the molten steel pouring nozzle B of the first embodiment of the present invention comprises an upper nozzle 20 made of a refractory, a lower nozzle 23 made of a refractory, and an open air shutoff means 31.

The upper nozzle 20 has along the center axis thereof an upper bore 21, and an upper end portion of the upper nozzle 20 is to be vertically inserted into an opening provided in a bottom wall of a tundish (not shown) as a molten steel receiving vessel. A lower end portion 22 of the upper nozzle 20 is tapered.

The lower nozzle 23 has along the center axis thereof a lower bore 24 aligning with the upper bore 21, and has, on an upper end portion 25 thereof, a recess 26 for receiving the lower end portion 22 of the upper nozzle 20. The recess 26 is formed coaxially with the lower bore 24 and communicates therewith. The lower bore 24 of the lower nozzle 23 forms a vertical path 27 for molten steel in cooperation with the upper bore 21 of the upper nozzle 20.

The open air shutoff means 31 comprises a steel shell 32 covering the upper end portion 25 of the lower nozzle 23, an annular equalizing chamber 35 provided between the upper end portion 25 of the lower nozzle 23 and a side surface 32*b* of the steel shell 32, and a plurality of grooves 36 formed between an upper end surface 30 of the lower nozzle 23 and an upper surface 32*a* of the steel shell 32.

The side surface 32*b* of the steel shell 32 is formed into a cylindrical shape so as to cover the circumference of the upper end portion 25 of the lower nozzle 23, and the upper surface 32*a* of the steel shell 32 is welded to the upper end of the side surface 32*b* thereof. The upper surface 32*a* of the steel shell 32 has, at the center thereof, an opening 33 for receiving the lower end portion 22 of the upper nozzle 20, and the opening 33 has a size slightly larger than the recess 26 of the lower nozzle 23. The side surface 32*b* of the steel shell 32 has, at the upper end portion thereof, an inert gas feed port 34. The side surface 32*b* of the steel shell 32 is stuck to the upper end portion 25 of the lower nozzle 23 by means of an adhesive 37 such as mortar, and the upper surface 32*a* of the steel shell 32 is welded to the upper end of the side surface 32*b* of the steel shell 32 after the side surface 32*b* of the steel shell 32 has thus been stuck to the upper end portion 25 of the lower nozzle 23 by means of the adhesive 37.

The annular equalizing chamber 35 is provided, between the upper end portion 25 of the lower nozzle 23 and the side surface 32*b* of the steel shell 32, over the entire circumference of the upper end portion 25 of the lower nozzle 23. More specifically, the annular equalizing chamber 35 is defined by an annular notch 29 formed by cutting the outside surface of the upper end portion 25 of the lower nozzle 23 over the entire circumference thereof, and by the side surface 32*b* of the steel shell stuck to the upper end portion 25 of the lower nozzle 23. The annular equalizing chamber 35 communicates with the inert gas feed port 34 of the steel shell 32, and the inert gas feed port 34 is connected through a pipe (not shown) to an inert gas source (not shown).

The plurality of grooves 36 are formed between an upper end surface 30 of the lower nozzle 23 and the upper surface 32*a* of the steel shell 32, by radially cutting the upper end surface 30 of the lower nozzle 23 at prescribed intervals in the circumferential direction of the lower nozzle (23). One end of each of the plurality of grooves 36 communicates with the above-mentioned annular equalizing chamber 35, and the other end thereof communicates with the recess 26 of the lower nozzle 23. Therefore, the plurality of grooves 36 direct an inert gas supplied in the annular equalizing chamber 35 toward the lower end portion 22 of the upper nozzle 20. As shown in FIGS. 2 and 3, each of the plurality of grooves 36 has a constant width and a constant depth, and the cross-sectional area thereof is substantially constant throughout the entire length thereof.

According to the above-mentioned molten steel pouring nozzle B of the first embodiment of the present invention, an inert gas supplied from the inert gas source (not shown) through the inert gas feed port 34 into the annular equalizing chamber 35 flows through the plurality of grooves 36, is ejected toward the lower end portion 22 of the upper nozzle 20, and discharged to the open air through the gap between the edge of the opening 33 in the upper surface 32*a* of the steel shell 32 and the lower end portion 22 of the upper nozzle 20. As a result, the circumference of the lower end portion 22 of the upper nozzle 20 is filled with the inert gas, thus preventing the open air from penetrating through an interface 28 between the lower end portion 22 of the upper nozzle 20 and the recess 26 of the lower nozzle 23 into the vertical path 27 for molten steel formed by the upper bore 21 of the upper nozzle 20 and the lower bore 24 of the lower nozzle 23.

In the molten steel pouring nozzle B of the first embodiment of the present invention, in which a sealing member made of a porous refractory as in the molten steel pouring nozzle A of the prior art is not used, it is possible to avoid penetration of an open air into the vertical path 27 for molten steel caused by cracks in the sealing member, and to reduce the manufacturing cost through decrease in the number of parts of the molten steel pouring nozzle.

In the above-mentioned molten steel pouring nozzle B of the first embodiment of the present invention, the plurality of grooves 36 are radially formed on the upper end surface 30 of the lower nozzle 23, and each of the plurality of grooves 36 has a constant width and a constant depth, with substantially a uniform cross-sectional area throughout the entire length thereof. The flow velocity and the flowing direction of the inert gas flowing through each of the plurality of grooves 36 may be altered by changing the shape thereof.

FIGS. 4(A) to 4(D) are plan views illustrating variations of the plurality of grooves 36 provided on the upper end surface 30 of the lower nozzle 23 shown in FIG. 3, as one of the components of the molten steel pouring nozzle B of the first embodiment of the present invention. Each of grooves 36*a* shown in FIG. 4(A) has a constant depth and the cross-sectional area thereof becomes larger from the annular notch 29 toward the recess 26. Each of grooves 36*b* shown in FIG. 4(B) has a constant depth and is formed into a V-shape. Each of grooves 36*c* shown in FIG. 4(C) has a constant width and a constant depth, and the longitudinal direction thereof deviates from the radial direction of the lower nozzle 23. Each of grooves 36*d* shown in FIG. 4(D) has a constant depth, and the cross-sectional area thereof becomes smaller from the annular notch 29 toward the recess 26. The variations of the plurality of grooves 36 are not limited to the above-mentioned grooves 36*a*, 36*b*, 36*c* and 36*d* having a constant depth, but may be a groove (not shown) having a constant width and a gradually varying depth or may be a curved groove (not shown).

Figure 5:
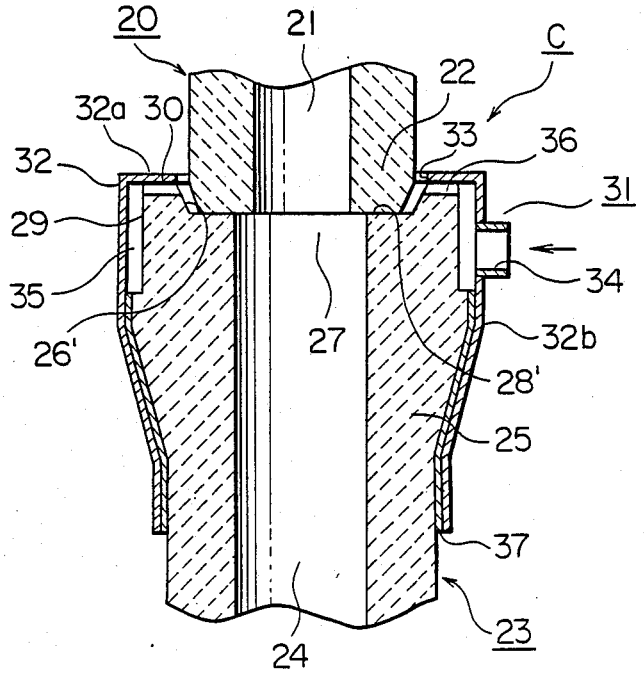
FIG. 5 is a schematic vertical partial sectional view illustrating a second embodiment of the molten steel pouring nozzle of the present invention, which is to be fitted to a bottom wall of a molten steel receiving vessel such as a ladle or a tundish.

FIG. 5 is a schematic vertical partial sectional view illustrating a second embodiment of the molten steel pouring nozzle of the present invention, which is to be fitted to a bottom wall of a molten steel receiving vessel such as a ladle or a tundish.

The molten steel pouring nozzle C of the second embodiment of the present invention shown in FIG. 5 is the same in the components as the molten steel pouring nozzle B of the first embodiment of the present invention except for the shape of a recess 26' formed on the upper end portion 25 of the lower nozzle 23. The same components are therefore given the same reference numerals and description thereof is omitted. More particularly, in the molten steel pouring nozzle B of the first embodiment of the present invention shown in FIG. 2, the recess 26 formed on the upper end portion 25 of the lower nozzle 23 comprises an inclined surface in contact with the outer side surface of the lower end portion 22 of the upper nozzle 20. Therefore, the interface 28 between the lower end portion 22 of the upper nozzle 20 and the recess 26 of the lower nozzle 23 is along the above-mentioned inclined surface. In the molten steel pouring nozzle C of the second embodiment of the present invention shown in FIG. 5, on the other hand, the recess 26' formed on the upper end portion 25 of the lower nozzle 23 comprises an inclined surface slightly apart from the outer side surface of the lower end portion 22 of the upper nozzle 20, and a horizontal surface which horizontally extends from the lower end of the above-mentioned inclined surface toward the lower bore 24 of the lower nozzle 23 and is in contact with the lower end surface of the upper nozzle 20. Therefore, the interface 28' between the lower end portion 22 of the upper nozzle 20 and the recess 26' of the lower nozzle 23 is along the above-mentioned horizontal surface.

According to the molten steel pouring nozzle C of the second embodiment of the present invention, the same effects as those mentioned above brought about by the molten steel pouring nozzle B of the first embodiment of the present invention are available.

The above-mentioned molten steel pouring nozzles B and C of the first and second embodiments of the present invention have been described as the nozzles for pouring molten steel received in a tundish into a vertical mold. Needless to say, these molten steel pouring nozzles B and C may be used also as the nozzles for pouring molten steel received in a ladle into a tundish.

Now, the molten steel pouring nozzle of the present invention is described further in detail by means of an example while comparing with the molten steel pouring nozzle of the prior art.

EXAMPLE

With the use of the molten steel pouring nozzle B of the first embodiment of the present invention shown in FIG. 2, molten steel received in a ladle was poured into a tundish while supplying argon gas as an inert gas from the inert gas feed port 34 thereof. During pouring of molten steel, flux was added to molten steel in the ladle and the tundish to prevent oxidation of molten steel. The nitrogen content in molten steel in the ladle at the start of pouring and that in molten steel in the tundish at the end of pouring were measured to determine the difference between these two nitrogen contents.

The above-mentioned operation was carried out for ten ladles. The result is shown in Table 1.

The above-mentioned operation was carried out also for the molten steel pouring nozzle A of the prior art shown in FIG. 1. The result is shown also in Table 1.

The upper nozzle 20 and the lower nozzle 23 of the molten steel pouring nozzle B of the present invention and the upper nozzle 1 and the lower nozzle 4 of the molten steel pouring nozzle A of the prior art had the following chemical composition:

| | |
|---|---|
| graphite | 26 wt. %, |
| alumina | 45 wt. %, |
| silica | 26 wt. %, and |
| silicon carbide | 3 wt. %. |

TABLE 1

| Number of times of pouring molten steel by ladle | 1 | 2 | 3 | 4 | 5 | 6 | 7 | 8 | 9 | 10 |
|---|---|---|---|---|---|---|---|---|---|---|
| Difference between Molten steel | | | | | | | | | | |

TABLE 1-continued

| Number of times of pouring molten steel by ladle | | 1 | 2 | 3 | 4 | 5 | 6 | 7 | 8 | 9 | 10 |
|---|---|---|---|---|---|---|---|---|---|---|---|
| nitrogen content in molten steel in ladle at start of pouring and that in molten steel in tundish at end of pouring (ppm) | pouring nozzle A of prior art | 0.92 | 1.87 | 3.64 | 5.06 | 5.86 | 6.21 | — | — | — | — |
| | Molten steel pouring nozzle B of the present invention | 0.46 | 0.71 | 1.12 | 1.30 | 1.68 | 1.90 | 2.47 | 3.11 | 4.21 | 4.96 |

As is clear from Table 1, in the case where the molten steel pouring nozzle B of the present invention is used, the difference between the nitrogen content in molten steel in the ladle at the start of pouring and that in molten steel in the tundish at the end of pouring is very small. This suggests that, in the molten steel pouring nozzle B of the present invention, the amount of an open air penetrating through the interface 28 between the upper nozzle 20 and the lower nozzle 23 is very small, and therefore, a sufficient sealing property of the interface 28 is ensured. Furthermore, the difference between the nitrogen content in molten steel in the ladle at the start of pouring and that in molten steel in the tundish at the end of pouring is relatively small as 4.96 ppm even in the 10th pouring of molten steel by ladle, thus revealing the possibility of using the molten steel pouring nozzle B of the present invention for a long period of time.

In the case where the molten steel pouring nozzle A of the prior art is used, in contrast, the difference between the nitrogen content in molten steel in the ladle at the start of pouring and that in molten steel in the tundish at the end of pouring is relatively large, and in addition, the difference in nitrogen content considerably increases accordingly as pouring of molten steel is repeated. This suggests that, in the molten steel pouring nozzle A of the prior art, the amount of an open air penetrating through the interface 9 between the upper nozzle 1 and the lower nozzle 4 considerably increases accordingly as pouring of molten steel is repeated. As a result, it was no longer possible to use the molten steel pouring nozzle A of the prior art after 6th pouring of molten steel by ladle.

Because the number of parts of the molten steel pouring nozzle B of the present invention is smaller than that of the molten steel pouring nozzle A of the prior art, the manufacturing cost of the molten steel pouring nozzle B is reduced by about 36% as compared with that of the molten steel pouring nozzle A.

Also for the molten steel pouring nozzle C of the second embodiment of the present invention shown in FIG. 5, effects similar to those of the above-mentioned molten steel pouring nozzle B of the present invention were observed.

According to the present invention, as described above in detail, it is possible to obtain a molten steel pouring nozzle which ensures a sufficient sealing property of an interface between the upper nozzle and the lower nozzle, thus preventing deterioration of the quality of a cast steel strand caused by the penetration of an open air through the above-mentioned interface, and is manufacturable at a low cost, thus providing industrially useful effects.

What is claimed is:

1. A molten steel pouring nozzle, comprising:

an upper nozzle (20) made of a refractory, having along the center axis thereof an upper bore (21), an upper end portion of said upper nozzle (20) inserted into an opening in a bottom wall of a molten steel receiving vessel;

a lower nozzle (23) made of a refractory, having along the center axis thereof a lower bore (24) aligning with said upper bore (21), and having, on an upper end portion (25) thereof, a recess (26, 26') for receiving a lower end portion (22) of said upper nozzle (20), said lower bore (24) of said lower nozzle (23) forming a vertical path (27) for molten steel in cooperation with said upper bore (21) of said upper nozzle (20); and an open air shutoff means (31) for preventing an open air from penetrating through an interface (28, 28') between said lower end portion (22) of said upper nozzle (20) and said recess (26, 26') of said lower nozzle (23) into said vertical path (27) for molten steel, said open air shutoff means comprising:

a steel shell (32) covering said upper end portion (25) of said lower nozzle (23), said steel shell having, at the center of an upper surface (**32*a*) thereof, an opening (33) having a size slightly larger than that of said recess (26, 26') of said lower nozzle (23), for receiving said lower end portion (22) of said upper nozzle (20), and said steel shell (32) having, on a side surface (32*b*) thereof, an inert gas feed port (34**);

an annular equalizing chamber (35), provided between said upper end portion (25) of said lower nozzle (23) and said side surface (**32*b*) of said steel shell (32), over the entire circumference of said upper end portion (25) of said lower nozzle (23), said annular equalizing chamber communicating with said inert gas feed nozzle (34) of said steel shell (32); and a plurality of grooves (36, 36*a*, 36*b*, 36*c*, 36*d*) formed at prescribed intervals in the circumferential direction of said lower nozzle (23) between an upper end surface (30) of said lower nozzle (23) and said upper surface (32*a*) of said steel shell (32), said plurality of grooves being directed toward said lower end portion (22) of said upper nozzle (20), one end of each of said plurality of grooves communicating with said annular equalizing chamber (35), and the other end thereof communicating with said recess (26, 26') of said lower nozzle (23**).

* * * * *